US008210795B2

(12) United States Patent
Lin et al.

(10) Patent No.: US 8,210,795 B2
(45) Date of Patent: Jul. 3, 2012

(54) FLOW-GUIDING DEVICE AND FAN ASSEMBLY

(75) Inventors: Wei-Yi Lin, Taoyuan Hsien (TW); Jiun-Ying Lin, Taoyuan Hsien (TW); Cheng-Wei Yan, Taoyuan Hsien (TW); Ching-Shyang Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 1246 days.

(21) Appl. No.: 11/949,528

(22) Filed: Dec. 3, 2007

(65) Prior Publication Data

US 2008/0138201 A1 Jun. 12, 2008

(30) Foreign Application Priority Data

Dec. 8, 2006 (TW) ..... 95145987 A

(51) Int. Cl.
*F04D 25/16* (2006.01)

(52) U.S. Cl. ..... 415/66; 415/68; 415/199.5

(58) Field of Classification Search ..... 415/199.5, 415/199.6, 68, 66, 209.1; 416/128, 120
See application file for complete search history.

(56) References Cited

U.S. PATENT DOCUMENTS 5,393,197 A * 2/1995 Lemont et al. ..... 415/68
6,508,621 B1 * 1/2003 Zeighami et al. ..... 415/119
6,663,342 B2 * 12/2003 Huang et al. ..... 415/121.2
6,799,942 B1 * 10/2004 Tzeng et al. ..... 415/61

* cited by examiner

*Primary Examiner* — Edward Look
*Assistant Examiner* — Dwayne J White
(74) *Attorney, Agent, or Firm* — Birch, Stewart, Kolasch & Birch, LLP

(57) ABSTRACT

A flow-guiding device, connected between two fans disposed in series and rotating in the same rotation direction, includes a main frame and a plurality of flow-guiding pieces. The flow-guiding pieces are connected with the main frame. Each of the flow-guiding pieces is disposed corresponding to the stationary flow guiding device of the above fan so as to form a completed flow guiding device. A fan assembly including the flow-guiding device is also disclosed.

19 Claims, 7 Drawing Sheets

1

1

2

2

FLOW-GUIDING DEVICE AND FAN ASSEMBLY

CROSS REFERENCE TO RELATED APPLICATIONS

This Non-provisional application claims priority under 35 U.S.C. §119(a) on Patent Application No(s). 095145987 filed in Taiwan, Republic of China on Dec. 8, 2006, the entire contents of which are hereby incorporated by reference.

BACKGROUND OF THE INVENTION

1. Field of Invention

The invention relates to a flow-guiding device and a fan assembly. In particular, the invention relates to a flow-guiding device and a fan assembly with better efficiency.

2. Related Art

As electronic devices have better performance, operate at higher frequencies and speeds, and become more compact, they generally generate more heat. They are therefore likely to be unstable, lowering the reliability thereof. Therefore, heat dissipation is an important issue of the field. Using the fan as a heat dissipating device is a common solution. To enhance heat dissipation, several fans are often connected in series.

As shown in FIG. 1, a conventional fan assembly 1 consists of an above fan 11 and a below fan 12 connected in series. The above fan 11 has a fan frame 111 and an impeller 112 disposed inside the fan frame 111. It also has several blades 1121 and a hub 1122 connected with each other. The above fan 11 further has several static blades 113 connected with the fan frame 111. The below fan 12 also has a fan frame 121, an impeller 122, and several static blades 123. The impeller 122 also has several blades 1221 and a hub 1222. The structure of the below fan 12 is the same as the above fan 11. They rotate in the same direction (as indicated by the arrow in FIG. 1). The fan assembly 1 is shown in FIG. 2.

The airflow in the fan assembly 1 is illustrated in FIG. 3, where the rotation direction R of the blades is also indicated. When the above fan 11 rotates, airflow goes from the blades 1121 to the static blades 113. Once the airflow is guided by the static blades 113 to the below fan 12, it goes to the low pressure area L of the blades 1221. This reduces the pressure difference between the high pressure area H and the low pressure area L of the blades 1221. Moreover, the airflow guided by the static blades is almost perpendicular to the blades 1221. These factors greatly reduce the efficiency of the below fan 12. Therefore, the air pressure and quantity output by the fan assembly are reduced.

SUMMARY OF THE INVENTION

In view of the foregoing, the invention is to provide a flow-guiding device and a fan assembly that can increase the output air pressure and quantity and thus the entire performance.

To achieve the above, the invention discloses a flow-guiding device connected between two series fans rotating in the same direction. The flow-guiding device includes a frame and a plurality of flow-guiding pieces connected with the frame. Each of the flow-guiding pieces and a corresponding static blade of the above fan form a flow-guiding element.

To achieve the above, the invention also discloses a fan assembly including two fans and a flow-guiding device. The fans rotate in the same direction and are connected in series. The flow-guiding device is connected between the two fans and has a frame and several flow-guiding pieces connected to the frame. Each of the flow-guiding pieces and a corresponding static blade of the above fan form a flow-guiding element.

As mentioned above, in the flow-guiding device and fan assembly of the invention, the flow-guiding elements are formed by several flow-guiding pieces and the static blades of the above fan. This does not only enhance the flow-guiding effect of the static blades, but also greatly increase the efficiency of the below fan. The output air pressure and quantity and thus the overall performance of the fan assembly become much better than the prior art.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
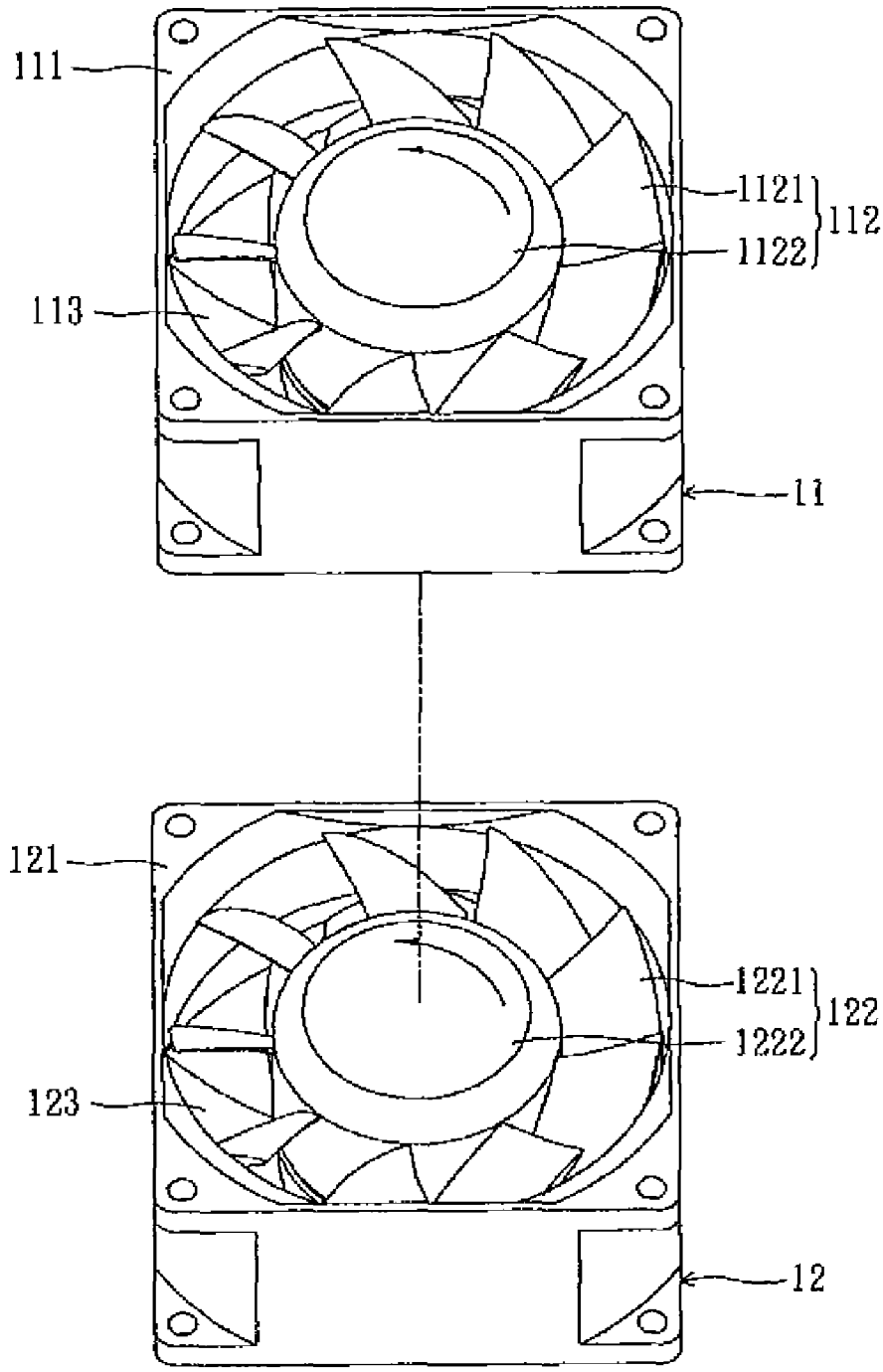
FIG. 1(PRIOR ART)
FIG. 1 is an exploded view of the conventional fan assembly.
Figure 2:
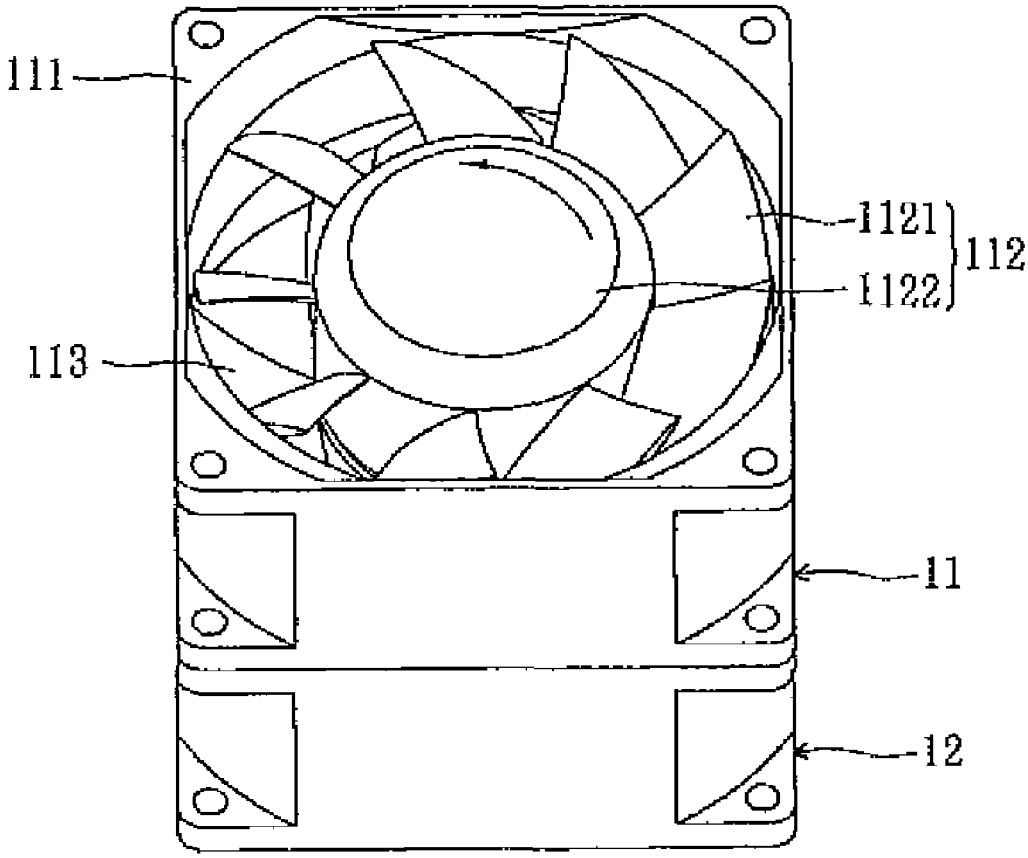
FIG. 2(PRIOR ART)
FIG. 2 shows the fan assembly of FIG. 1.
Figure 3:
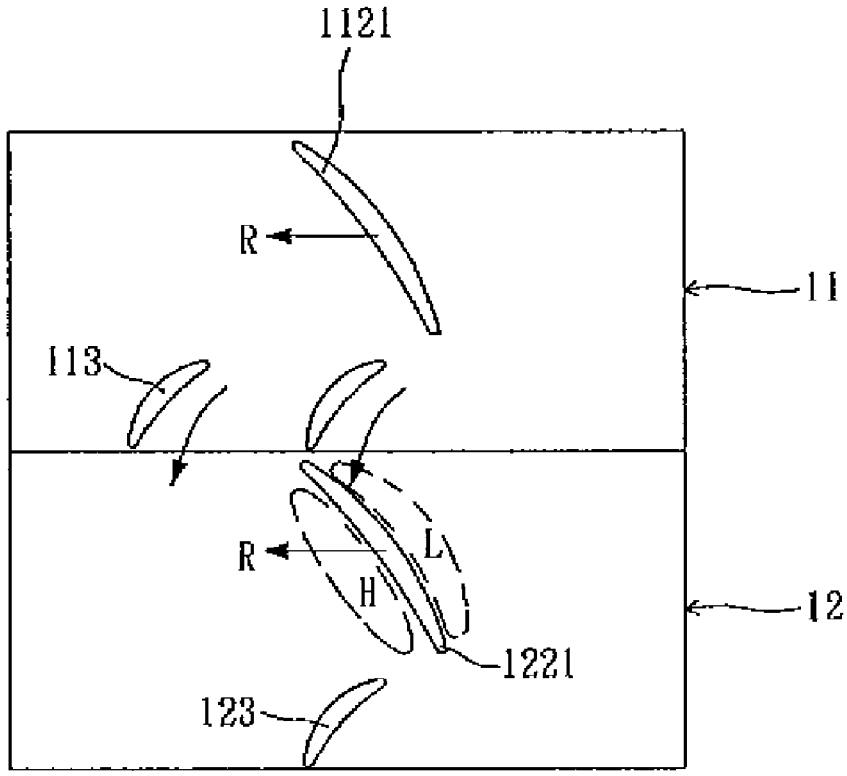
FIG. 3(PRIOR ART)
FIG. 3 shows the airflow in the fan assembly of FIG. 2.
Figure 4:
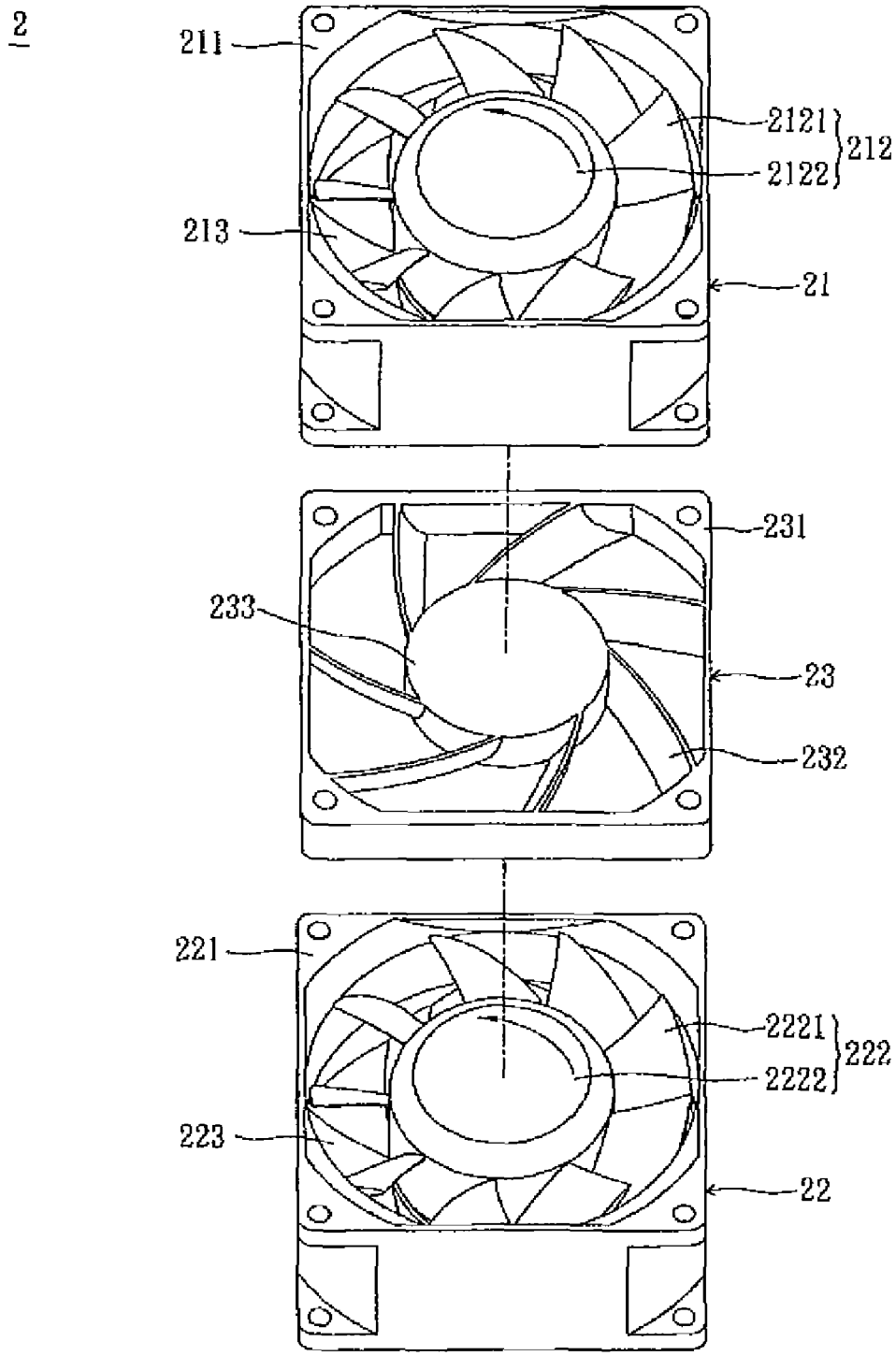
FIG. 4 is an exploded view of the fan assembly according to an embodiment of the invention.

As shown in FIG. 4, the fan assembly 2 according to an embodiment of the invention includes two fans 21, 22 and a flow-guiding device 23. The fans 21, 22 are connected in series and rotate in the same direction (as indicated by the arrow). The flow-guiding device 23 is connected between the fans 21, 22 and has a frame 231 and several flow-guiding pieces 232. One end of each flow-guiding piece 232 is connected with the frame 231. Moreover, the flow-guiding device 23 further includes a connecting part 233. The other end of the flow-guiding piece 232 is connected with the connecting part 233. The flow-guiding pieces 232 in this embodiment can be disposed in a symmetric or asymmetric way.

In this embodiment, the fan 21 is the above fan and the fan 22 is the below fan. The fan 21 has a fan frame 211, an impeller 212 disposed inside the fan frame 211, several blades 2121, and a hub 2122. The blades 2121 are connected to the hub 2122. Besides, the fan 21 further has several static blades 213 connected with the fan frame 211. The fan 22 also has a fan frame 221, an impeller 222 disposed inside the fan frame 221, several blades 2221, and a hub 2222. The blades 2221 are connected to the hub 2222. The fan 22 further has several static blades 223 connected with the fan frame 221. In this embodiment, the fans 21, 22 can be axial-flow fans. They may have same or different structures. However, the rotation directions have to be the same.

Figure 5:
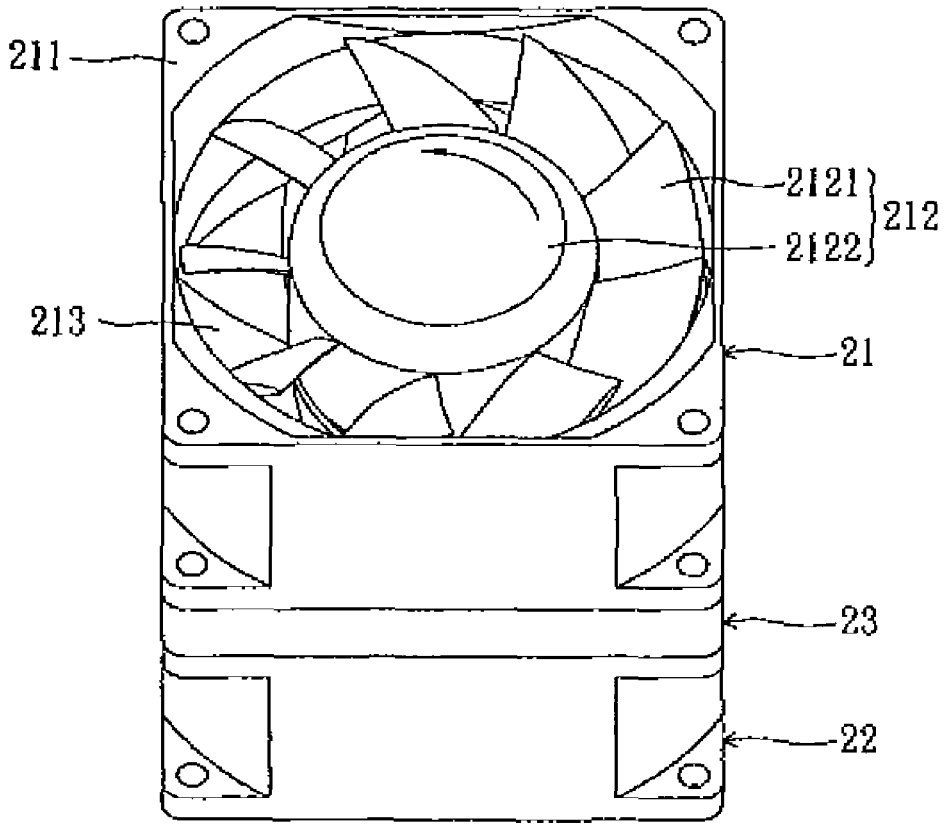
FIG. 5 shows the fan assembly in series of FIG. 4.

The frame 231 of the flow-guiding device 23 is connected to the fan frames 211, 221 of the fans 21, 22. The connection method can be fastening, locking, embedding, or gluing. The fan assembly 2 connected in series is shown in FIG. 5.

Figure 6:
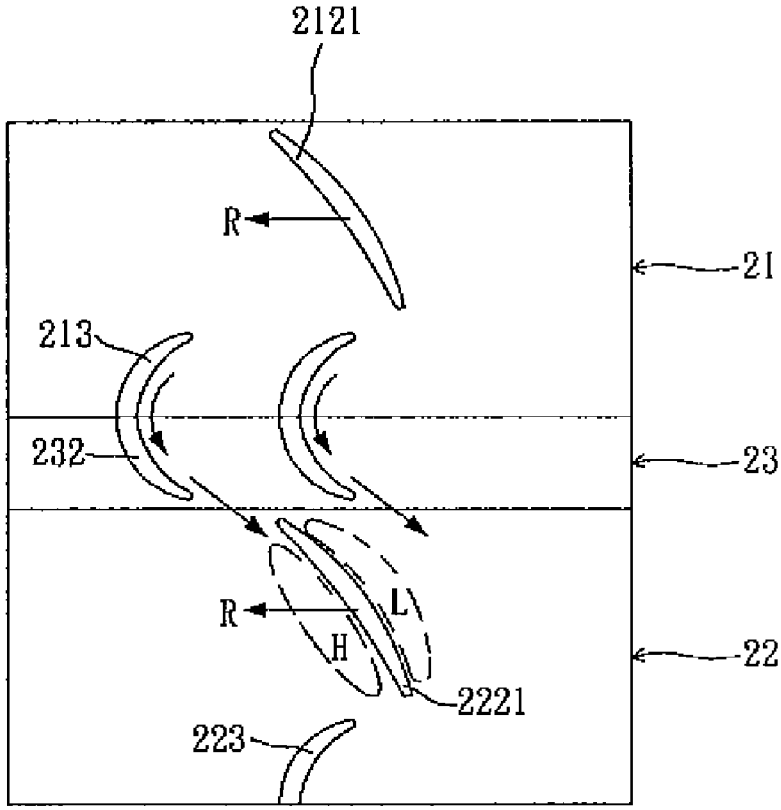
FIG. 6 shows the airflow in the fan assembly of FIG. 5.

The airflow of the fan assembly 2 is illustrated in FIG. 6, where the rotation direction R of the blades is also indicated. Once the fan assembly 2 is assembled, each flow-guiding piece 232 and a corresponding static blade 213 of the fan 21 form a flow-guiding element. Here the number of the flow-guiding pieces 232 and the number of the static blades 213 are the same. In this embodiment, the flow-guiding piece 232 and the static blades 213 of the fan 21 have a half crescent cross-section. The combination of the static blades 213 and the flow-guiding pieces 232 forms crescent air-guiding elements. It should be noted that the crescent-guiding element mentioned above is only one example of the invention. The numbers and shapes of the flow-guiding pieces 232 and the static blades 213 do not need to be same. The shape of the flow-guiding pieces 232 can be different from that of the static blades 213. Besides, the flow-guiding piece 232 has shrinking, expanding or constant thickness.

When the fan 21 rotates, airflow is induced to flow from the blades 2121 to the static blades 213 and the flow-guiding pieces 232. The flow-guiding elements formed by the static blades 213 and the flow-guiding pieces 232 not only guide the airflow to enhance the fan efficiency, but also connect the high pressure areas H of the outlet of the above fan and inlet of the below fan. The performance of the invention is much better than that of the fan assembly with only static blades 213.

Figure 7:
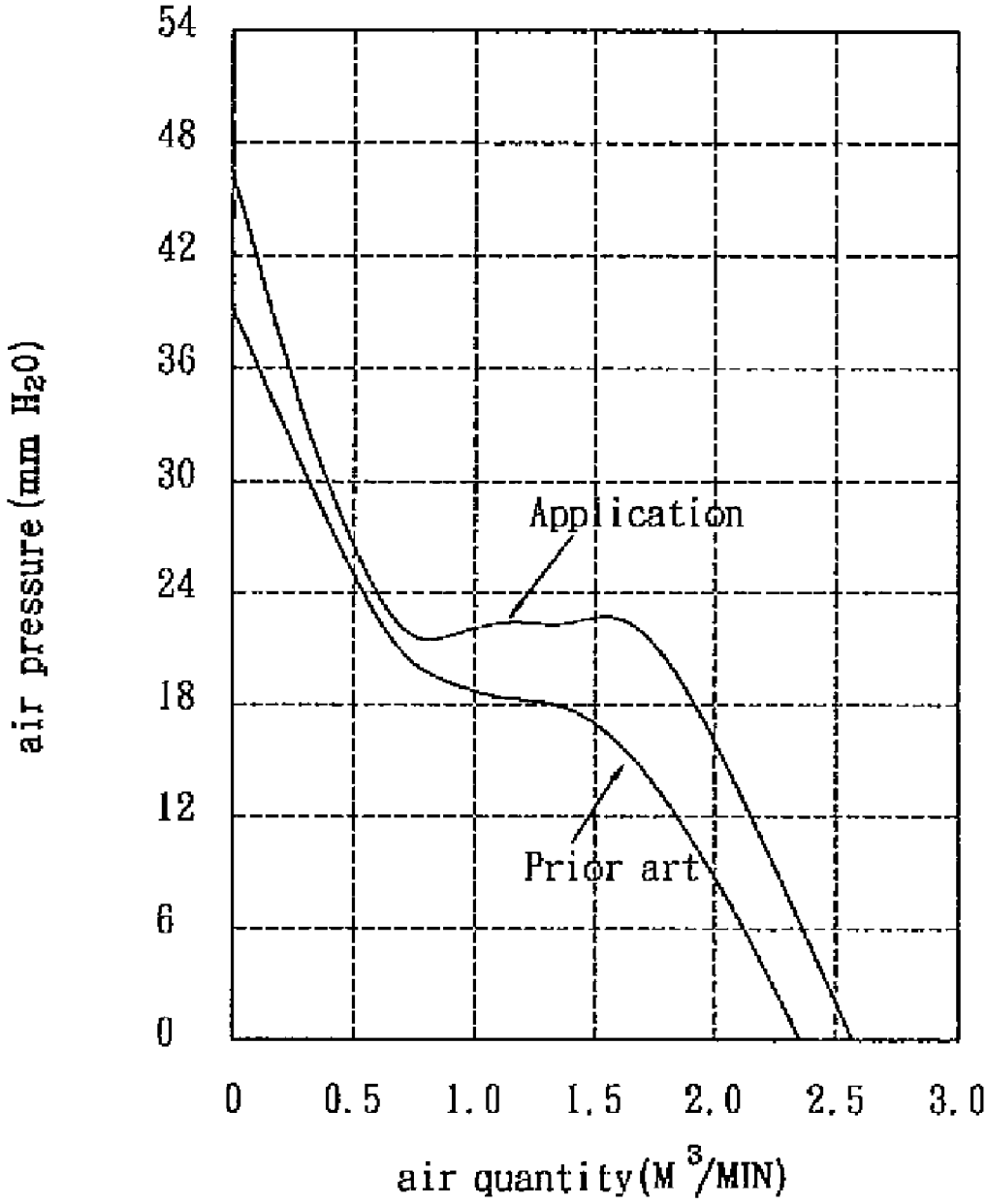
FIG. 7 shows the fan performance curve comparing the conventional fan assembly with the fan assembly of the embodiment.

Please refer to FIG. 7. It shows the experimental comparison between the conventional fan assembly 1 and the disclosed fan assembly 2 with the flow-guiding device 23. The horizontal axis represents the air quantity, and the vertical axis represents the air pressure. The fan performance curve shows that the invention outputs larger air pressure and quantity at the same rotation speed.

In summary, in the flow-guiding device and fan assembly of the invention, the flow-guiding elements are formed by several flow-guiding pieces and the static blades of the above fan. This does not only enhance the flow-guiding effect of the static blades, but also greatly increase the efficiency of the below fan. The output air pressure and quantity and thus the overall performance of the fan assembly become much better than the prior art.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A flow-guiding device connected between two fans, comprising:

a frame; and a plurality of flow-guiding pieces disposed inside the frame, wherein the flow-guiding pieces are disposed corresponding to static blades of one of the fans, and wherein the two fans are rotated in the same direction, wherein each of the fans has the static blades.

2. The flow-guiding device of claim 1, wherein the flow-guiding pieces are bent in the direction opposite to a rotation direction of the fan.

3. The flow-guiding device of claim 1, wherein the flow-guiding pieces are disposed in a symmetric or asymmetric way.

4. The flow-guiding device of claim 1, wherein each of the flow-guiding pieces and the static blades has a half crescent cross-section, and the flow-guiding piece and the static blade are assembled together to form a crescent air-guiding element.

5. The flow-guiding device of claim 1, wherein the frame is assembled with the fans by fastening, locking, embedding or gluing.

6. The flow-guiding device of claim 1, wherein a number of the flow-guiding pieces is identical to that of the static blades.

7. The flow-guiding device of claim 1, wherein the shape of the flow-guiding pieces is different from that of the static blades.

8. The flow-guiding device of claim 1, wherein the flow-guiding pieces respectively have shrinking, expanding or constant thickness.

9. The flow-guiding device of claim 1, further comprising a connecting part, wherein the flow-guiding pieces are connected between the frame and the connecting part.

10. A fan assembly comprising:

two fans connected in series and rotated in the same direction; and a flow-guiding device disposed between the two fans and having a frame and a plurality of flow-guiding pieces disposed in the frame, wherein the flow-guiding pieces are disposed corresponding to static blades of one of the fans, wherein each of the fans has the static blades.

11. The fan assembly of claim 10, wherein the flow-guiding pieces are bent in the direction opposite to a rotation direction of the fan.

12. The fan assembly of claim 10, wherein the flow-guiding pieces are disposed in a symmetric or asymmetric way.

13. The fan assembly of claim 10, wherein the fans are axial-flow fans.

14. The fan assembly of claim 10, wherein the frame and the fans are connected by fastening, locking, embedding or gluing.

15. The fan assembly of claim 10, wherein a number of the flow-guiding pieces is identical to that of the static blades.

16. The fan assembly of claim 10, wherein the shape of the flow-guiding pieces is different from that of the static blades.

17. The fan assembly of claim 10, wherein the flow-guiding pieces respectively have shrinking, expanding or constant thickness.

18. The fan assembly of claim 10, wherein each of the flow-guiding pieces and the static blades respectively has a half crescent cross-section, and the flow-guiding piece and the static blade are assembled together to form a crescent air-guiding element.

19. The fan assembly of claim 10, further comprising a connecting part, wherein the flow-guiding pieces are connected between the frame and the connecting part.

* * * * *